US009738090B1

(12) United States Patent
Letard et al.

(10) Patent No.: US 9,738,090 B1
(45) Date of Patent: Aug. 22, 2017

(54) THERMAL HEAD FOR THERMAL TRANSFER MACHINE

(71) Applicant: EVOLIS, Beaucouze (FR)

(72) Inventors: Benoit Letard, Beaucouze (FR); Anthony Chiron, Beaucouze (FR)

(73) Assignee: EVOLIS, Beacouze (FR)

( * ) Notice: Subject to any disclaimer, the term of this patent is extended or adjusted under 35 U.S.C. 154(b) by 0 days.

(21) Appl. No.: 15/127,659

(22) PCT Filed: Mar. 26, 2015

(86) PCT No.: PCT/EP2015/056661

§ 371 (c)(1),
(2) Date: Sep. 20, 2016

(87) PCT Pub. No.: WO2015/150242

PCT Pub. Date: Oct. 8, 2015

(30) Foreign Application Priority Data

Mar. 31, 2014 (FR) ..... 14 52771

(51) Int. Cl.

| | |
|---|---|
| ***B41J 2/335*** | (2006.01) |
| ***B41J 2/07*** | (2006.01) |
| *B41J 13/00* | (2006.01) |
| *B41J 15/00* | (2006.01) |
| *B41J 13/12* | (2006.01) |
| *B41J 11/00* | (2006.01) |

(52) U.S. Cl.
CPC ..... *B41J 2/33535* (2013.01); *B41J 2/072* (2013.01); *B41J 11/00* (2013.01); *B41J 13/00* (2013.01); *B41J 13/12* (2013.01); *B41J 15/00* (2013.01)

(58) Field of Classification Search
None
See application file for complete search history.

(56) References Cited

U.S. PATENT DOCUMENTS 9,403,394 B2 * 8/2016 Rosner ..... B41F 16/0046

FOREIGN PATENT DOCUMENTS

| | | | |
|---|---|---|---|
| JP | S63-74654 | A | 4/1988 |
| JP | S63-278874 | A | 11/1988 |
| JP | H01-216855 | A | 8/1989 |
| JP | 2004-188717 | A | 7/2004 |

OTHER PUBLICATIONS

Jun. 22, 2015 International Search Report issued in International Patent Application No. PCT/EP2015/056661.

* cited by examiner

*Primary Examiner* — Lisa M Solomon
(74) *Attorney, Agent, or Firm* — Oliff PLC; R. Brian Drozd

(57) ABSTRACT

A thermal head for a thermal transfer machine is provided to transfer a film onto a card. The thermal head may include a frame intended to be secured to the machine. The thermal head may also include a heating bar mounted on the frame, intended to create heat and having a heating surface designed to diffuse said heat towards the outside. The thermal head may yet also include a pad produced from a flexible material and fixed removably against the heating surface so as to be placed between the heating surface and the film.

8 Claims, 2 Drawing Sheets

THERMAL HEAD FOR THERMAL TRANSFER MACHINE

Figure 1:
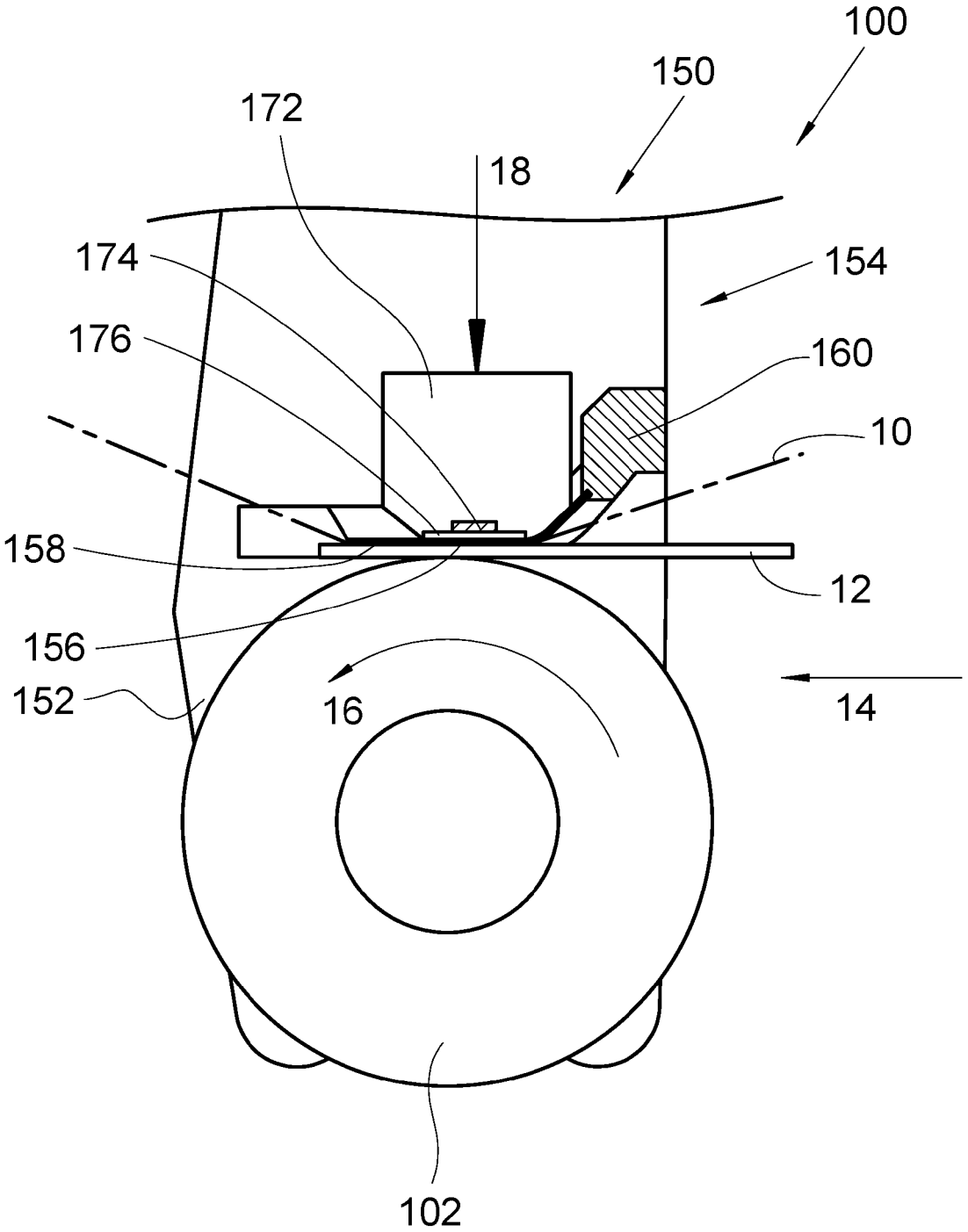

The present invention relates to a thermal head and to a thermal transfer machine.

A thermal transfer machine comprises a thermal head that enables a film to be transferred onto a plastic card by applying heat and pressure to the film sandwiched between the card and the thermal head.

A thermal head of the prior art consists of a block of rigid heat-conducting material in which a heating element is implanted.

A plastic card generally results from cropping by pressing, which may create irregularities on the surface of the card.

Such irregularities may prevent good adhesion of the film to the plastic card at the time of transfer.

The documents JP-A-2004/188717, JP-A-S63 74654 and JP-A-H01 216855 disclose thermal heads.

One object of the present invention is to propose a thermal head that does not have the drawbacks of the prior art and which in particular makes it possible to absorb the defects of the plastic card in order to ensure good adhesion of the film and provide easy replacement of the pad.

To this end, a thermal head is proposed for a thermal transfer machine intended to transfer a film onto a card, said thermal head comprising:

- a frame intended to be secured to the machine, and
- a heating bar mounted on the frame, intended to create heat and having a heating surface designed to diffuse said heat towards the outside, and
- a pad produced from a flexible material and fixed removably against the heating surface so as to be placed between the heating surface and the film.

Advantageously, the flexibility of the pad is around 80 Shore A.

Advantageously, the thermal head comprises an adhesive polyimide film bonded against the face of the pad that is opposite to the face fixed against the heating surface.

Advantageously, the thermal head further comprises a support on which the pad is fixed and the support is mounted removably on the frame.

Advantageously, the support takes the form of a slide having two lateral edges, the frame has two grooves, and each lateral edge is designed to slide in one of the grooves.

Advantageously, each lateral edge has an elastic lug, the frame has two housings, and each elastic lug is designed to be introduced into one of the housings when the support is in place in the frame.

Advantageously, each lateral edge has a protrusion, the frame has two holes, and each protrusion is designed to be housed in one of the holes when the support is in place in the frame.

The invention also proposes a thermal transfer machine comprising:

- a feed system designed to supply said machine with cards,
- a film-feed system designed to supply the machine with a film intended to be transferred onto said cards,
- a thermal head according to one of the above variants, where the face of the pad that is opposite to the face fixed against the heating surface comes into abutment against one face of the film, while the other face of the film comes into abutment against a face of the card.

Figure 2:
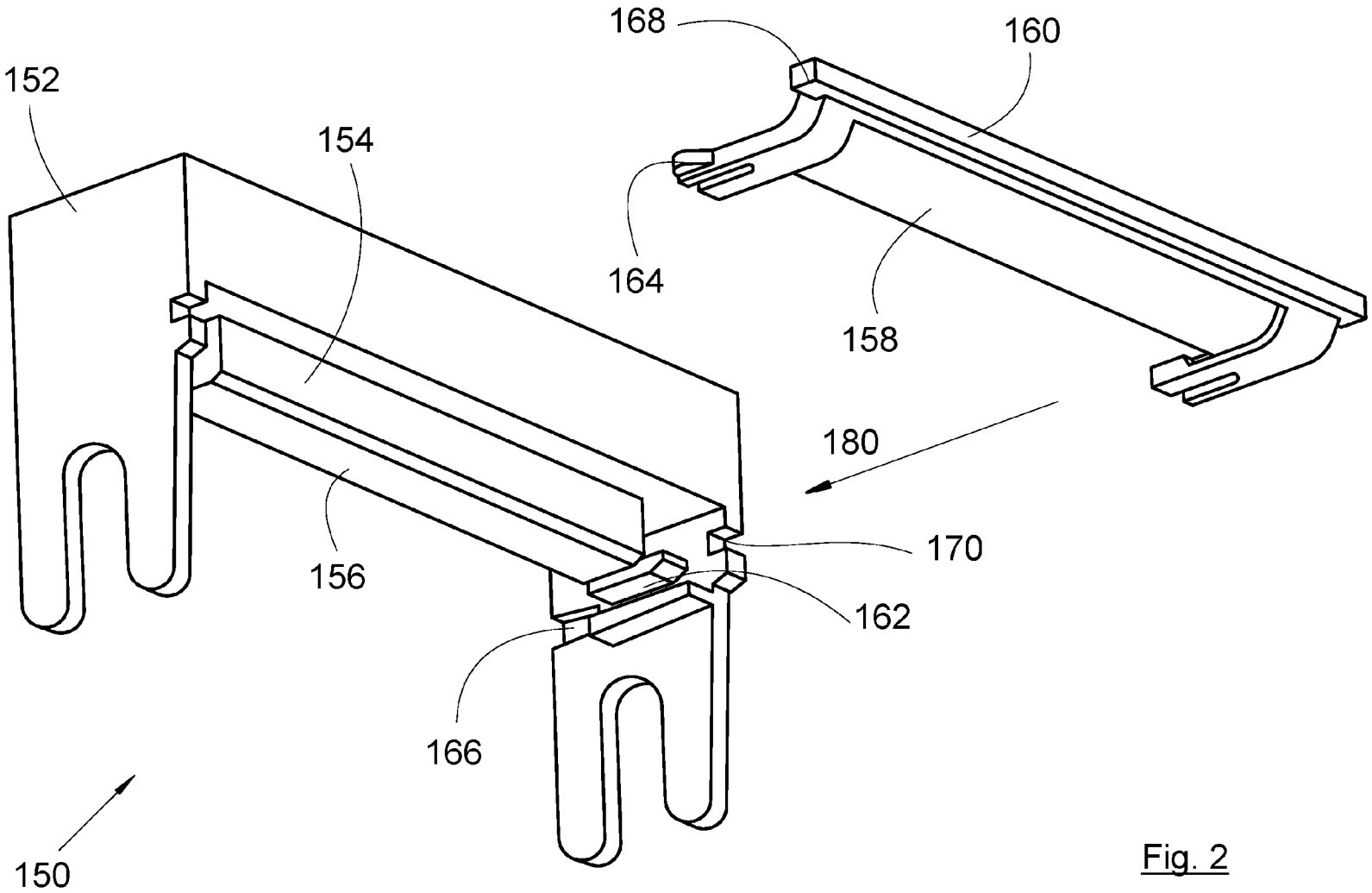

The features of the invention mentioned above, as well as others, will emerge more clearly from a reading of the following description of an example embodiment, said description being given in relation to the accompanying drawings, among which:

FIG. 1 shows a cross section of a part of a thermal transfer machine according to the invention, and FIG. 2 shows a particular embodiment of a thermal head according to the invention.

FIG. 1 shows a cross section of a thermal transfer machine 100 that is intended to transfer a film 10 onto a card 12, in particular a plastic card.

The machine 100 comprises a thermal head 150 and a card-feed system 12 that is designed to supply the machine 100 with cards 12 and to bring them one after the other.

The card 12 thus moves in the direction of the arrow 14 from a position upstream of the thermal head 150, where the film 10 is not fixed to the card 12, to a position downstream of the thermal head 150, where the film 10 is fixed to the card 12.

The machine 100 comprises a film-feed system that is designed to supply the film 100 with film 10 and which has for example a feed reel around which the film 10 to be transferred is wound and a recovery reel around which the parts of the film 10 that have not been transferred are wound. The feed reel is disposed upstream of the thermal head 150 and the recovery reel is disposed downstream of the thermal head 150. The film 10 also moves in the direction of the arrow 14.

The thermal head 150 comprises a frame 152 secured to the rest of the machine 100 and a heating bar 154 mounted on the frame 152 that has a heating surface 156, designed to diffuse heat towards the outside and in particular towards the transfer roller 102.

In the embodiment of the invention presented here, the heating bar 154 consists of a block 172 of thermally insulating material, in particular made from plastics material such as PEEK, a heating element 174 such as a heating element fixed to one face of the block 172, and a covering element 176 made from thermally conductive material such as ceramic, covering the heating element 174. Here the heat created by the heating element 174 diffuses through the covering element 176 and the heating surface 156 is formed by the external face of the covering element 176, that is to say the face opposite to the one facing the heating element 174.

The machine 100 comprises the transfer roller 102, which is rotated about its axis as shown by the arrow 16 and which is disposed opposite the heating surface 156.

The film 10 is positioned between the heating surface 156 and the transfer roller 102 and, when a card 12 is presented, is positioned between the film 10 and the transfer roller 102.

The thermal head 150 also comprises pressurising means, such as for example springs, which are designed to press the heating surface 156 against the transfer roller 102. These pressurising means are represented by the arrow 18.

Thus, when a card 12 is presented from upstream, it comes to be placed between the heating surface 156 and the transfer roller 102 with the film 10 placed between the card 12 and the heating surface 156. The heating element is then activated by suitable control means of the machine 100 and heats while the card 12 and the film 10 advance (arrow 14) and are pressed against each other (arrow 18).

FIG. 2 shows a particular embodiment of the thermal head 150.

The thermal head 150 comprises a pad 158 fixed against the heating surface 156 so as to be placed between the heating surface 156 and the film 10. The face of the pad 158 that is opposite to the face fixed against the heating surface 156 thus comes into abutment against one face of the film 10, while the other face of the film 10 comes into abutment against a face of the card 12.

The pad 158 is flexible and has a certain thickness. This flexibility and thickness absorb the irregularities of the card 12 and therefore improve the transfer of the film 10 onto the card 12. The pad 158 adopts the shape of the heating surface 156.

The hardness of the pad 158 is around 80 Shore A, which represents great flexibility.

The thickness of the pad 158 is around 0.3 mm.

The pad 158 is produced from a material having good thermal conductivity, preferably greater than 4 W/mK.

The pad 158 is produced from a material having a low coefficient of friction, preferably greater than 0.4, in order to limit the resistance to sliding of the film 10.

The pad 158 is produced for example from silicone with aluminium powder added.

To ensure better sliding of the film 10, an adhesive polyimide film may be bonded against the face of the pad 158 in contact with the film 10, that is to say against the face of the pad 158 that is opposite to the face fixed against the heating surface 156. The polyimide developed by the company Du Pont® under the name Kapton® may be used.

The fixing of the pad 158 against the heating surface 156 may be definitive, for example by adhesive bonding, but it is preferably removable to allow replacement of the pad 158 in the case of wear on the latter.

In the embodiment of the invention presented here, the thermal head 150 comprises a support 160 that is mounted removably on the frame 152 and on which the pad 158 is fixed, for example by adhesive bonding. The fixing is said to be removable if the support 160 can be put in place and removed from the frame 152 without either the pad 158 or the heating surface 156 being damaged.

The support 160 takes the form of a slide having two lateral edges. The frame 152 then has two grooves 162, and each lateral edge is designed to slide in one of the grooves 162. The support 160 is introduced into the frame 152 in the direction of the arrow 180.

Each lateral edge has an elastic lug 164 and the frame 152 has two housings 166. To ensure locking of the support 160 when the support 160 is in place in the frame 152, each elastic lug 164 is designed so as to be introduced into one of the housings 166.

Each lateral edge of said support 160 has a protrusion 168 and the frame 152 has two holes 170. To ensure correct positioning of the support 160 in the frame 152, when the support 160 is in place in the frame 152, each protrusion 168 is designed to be housed in one of the holes 170.

Naturally the present invention is not limited to the examples and embodiments described and depicted but is capable of numerous variants accessible to a person skilled in the art.

The invention claimed is:

1. A thermal head for a thermal transfer machine intended to transfer a film onto a card, said thermal head comprising:
   - a frame intended to be secured to the machine,
   - a heating bar mounted on the frame, intended to create heat and having a heating surface designed to diffuse said heat towards the outside, and
   - a pad produced from a flexible material and fixed removably against the heating surface so as to be placed between the heating surface and the film.

2. The thermal head according to claim 1, wherein the flexibility of the pad is around 80 Shore A.

3. The thermal head according to claim 1, wherein the thermal head comprises an adhesive polyimide film bonded against the face of the pad that is opposite to the face fixed against the heating surface.

4. The thermal head according to claim 1, wherein the thermal head further comprises a support to which the pad is fixed and the support is mounted removably on the frame.

5. The thermal head according to claim 4, wherein the support takes the form of a slide having two lateral edges, the frame has two grooves and each lateral edge is designed to slide in one of the grooves.

6. The thermal head according to claim 5, wherein each lateral edge has an elastic lug, the frame has two housings and each elastic lug is designed to be introduced into one of the housings when the support is in place in the frame.

7. The thermal head according to claim 5, wherein each lateral edge has a protrusion, the frame has two holes and each protrusion is designed to be housed in one of the holes when the support is in place in the frame.

8. A thermal transfer machine comprising:
   - a feed system designed to supply said machine with cards,
   - a film-feed system designed to supply the machine with a film intended to be transferred onto said cards, and
   - a thermal head according to claim 1 and where the face of the pad that is opposite to the face fixed against the heating surface comes into abutment against one face of the film, while the other face of the film comes into abutment against a face of the card.

* * * * *